US006095699A

United States Patent [19]

Baumann et al.

[11] Patent Number: 6,095,699

[45] Date of Patent: Aug. 1, 2000

[54] MACHINE FOR PRINTING FLAT OBJECTS, IN PARTICULAR ENVELOPES, WITH PRINTING DRUM AND THICKNESS COMPENSATING DEVICE

[75] Inventors: Hervé Baumann; Franck Viennet, both of Paris, France

[73] Assignee: SECAP, Boulogne Billancourt, France

[21] Appl. No.: 09/308,051

[22] PCT Filed: Aug. 21, 1998

[86] PCT No.: PCT/FR98/01837

§ 371 Date: May 12, 1999

§ 102(e) Date: May 12, 1999

[87] PCT Pub. No.: WO99/14054

PCT Pub. Date: Mar. 25, 1999

[30] Foreign Application Priority Data

Sep. 12, 1997 [FR] France ..... 97 11375

[51] Int. Cl.[7] ..... B41J 11/20

[52] U.S. Cl. ..... 400/56; 101/56; 101/91; 101/227

[58] Field of Search ..... 101/36, 37, 72, 101/76, 91, 92, 56, 227; 400/56

[56] References Cited

U.S. PATENT DOCUMENTS

| | | | |
|---|---|---|---|
| 4,470,349 | 9/1984 | Godlewski | 101/76 |
| 4,575,267 | 3/1986 | Brull | 400/56 |
| 4,705,413 | 11/1987 | Arnoldi et al. | 400/56 |
| 5,203,263 | 4/1993 | Berger et al. | 101/76 |
| 5,355,155 | 10/1994 | Mistyurik | 101/76 |
| 5,379,692 | 1/1995 | Haug | 101/227 |
| 5,961,224 | 10/1999 | Baitz et al. | 400/56 |
| 5,980,132 | 11/1999 | Kawai | 400/56 |

FOREIGN PATENT DOCUMENTS

| | | | |
|---|---|---|---|
| 40-13106977 | 12/1989 | Japan | 400/56 |
| 40-2113967 | 4/1990 | Japan | 400/56 |

*Primary Examiner*—Eugene Eickholt
*Attorney, Agent, or Firm*—St. Onge Steward Johnston & Reens LLC

[57] ABSTRACT

A machine for printing flat objects of various thicknesses successively fed the length of a table by means of a feed mechanism and printed by means of a printing mechanism is provided. The feed mechanism includes at least two feed rollers between which the objects pass. Each of the at least two feed rollers is rotatable about an axis of rotation and at least one of the feed rollers is motorized. The printing mechanism includes a revolving printing drum and a motorized counter-printing roller rotatable about an axis of rotation. The machine also includes a lever having a first end, a second end, and a middle. The lever is pivotable at its middle and joined at its middle by a stop joint. The first end of the lever supports the axis of rotation of the counter-printing roller, and the second end of the lever supports the axis of rotation of one of the at least two feed rollers, such that shifting of the feed roller whose axis is supported by the lever, subsequent to the passage of an object between the at least two feed rollers, causes pivoting of the lever and thus a corresponding shifting of the counter-printing roller, if not already shifted by the passage of a preceding object.

7 Claims, 8 Drawing Sheets

MACHINE FOR PRINTING FLAT OBJECTS, IN PARTICULAR ENVELOPES, WITH PRINTING DRUM AND THICKNESS COMPENSATING DEVICE

FIELD OF THE INVENTION

The present invention concerns machines for printing flat objects and, more particularly mail-handling machines intended to apply a cancellation or prepayment mark on envelopes, by printing through means of a rotative marking drum in conjunction with a counter-printing roller, permitting achievement of the printing force.

BACKGROUND OF THE INVENTION

Document EP-A-0547922, among many others, makes known such a machine for printing flat objects (envelopes in particular) of various thicknesses successively transported the length of a table by means of a feed mechanism and printed by means of a printing mechanism, the feed mechanism comprising at least two rollers, at least one roller of which is motorized, between which the objects pass, the printing mechanism comprising a turning printing drum and a motorized counter-printing roller.

The current machines printing the cancellation or prepayment marks with the aid of a rotative drum use one motor to drive the envelopes and another to drive the printing drum. The movement of the drum is described precisely in Document WO-A-96/26502. The drive motor of the printing drum performs an abrupt acceleration movement to permit the drum to meet the letter in perfect synchronization. Further, to permit the handling of thick envelopes, the drive motor of the printing drum must shift the counter-printing roller. As this last is firmly pressed against the drum, the abrupt movement performed by the drive motor is very important.

On the other hand, stepping motors are employed more and more for the printing drum motorization. While these show great advantages, they are nevertheless sensitive to abrupt changes in load.

SUMMARY OF THE INVENTION

The object of the present invention is to reduce these adjustment disadvantages and substantially decrease the work to be performed by the drive motor of the print drum.

The invention attains its object in the form of a machine of the type described above, thanks to an automatic and simple device for thickness compensation, that is, the axes of the counter-printing roller and one of the two feed rollers are supported by the ends of a lever pivoting in its center and linked at this place by a stop link such that the displacement of the said feed roller resulting from the passage of an object between the two feed rollers causes a pivoting of the lever and therefore a corresponding shifting of the counter-printing roller, if this was not already shifted by at least the said corresponding shifting by the passage of a preceding object.

Said otherwise, instead of the shifting action of the counter-printing roller being effected by the drive motor of the printing drum, it is in part effected by the motor of the feed rollers and the envelope itself at the moment it passes into the feed rollers. Therefore there is a decrease in required power from the drum motor and an augmentation in the same proportions of the power of the motor driving the envelopes. The technologies of the two motors being quite different, economical for the driving of the envelope and expensive for the driving of the printing roller, the present invention thus permits substantially decreasing the cost of the machine.

Advantageously, the said thickness-compensating lever is comprised of two covers, pivoted one on the other by a joint. A screw passes through an extension of one of the covers to rest against the other, in order to comprise an adjustable stop of the said joint.

Preferably, springs return the rollers shifted by the lever toward contact respectively with the opposing roller and the printing drum.

Advantageously, the counter-printing roller is motorized by the feed roller motor by means of a set of belt-pulleys.

BRIEF DESCRIPTION OF THE DRAWINGS

Other characteristics and advantages of the invention will be apparent upon the reading of the following description of an example of embodiment and referring to the attached drawings on which.

DETAILED DESCRIPTION OF THE INVENTION

The mail-handling machine comprises a principal structure formed of two parallel vertical platens before 1 and behind 1' connected with Stretchers 2. This caisson structure allows the installation and control of the various elements comprising the machine.

Horizontal Table 22 is installed in front, perpendicular to Platen 1, for the control of the envelopes to be printed.

The mechanism for feeding envelopes comprises Motor Roller 3 installed in front of Platen 1 on Arbor 4 which is put in rotation by Motor 5, placed at the rear of Platen 1'.

The printing mechanism comprises Printing Drum 6, which is engraved with the mark to be printed. The Drum is also installed in front of Platen 1, on Arbor 7 put in rotation by Motor 8 placed in the rear.

Possibly, an envelope ejection mechanism, not embodied, comprised of conventional rollers may be placed after the printing mechanism.

Figure 1:
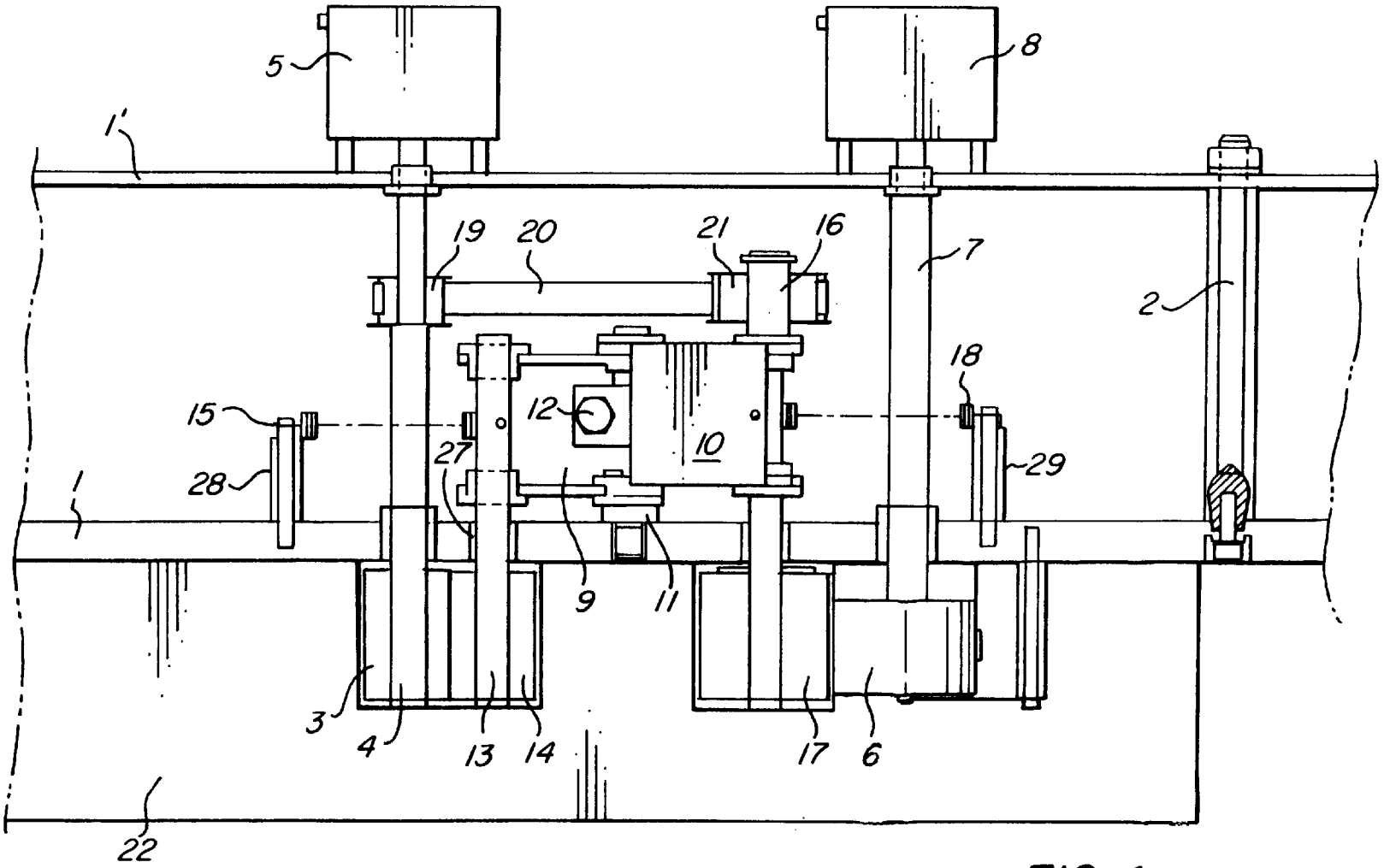
FIG. 1 is a developed sectional view of a printing machine according to the invention.
Figure 2:
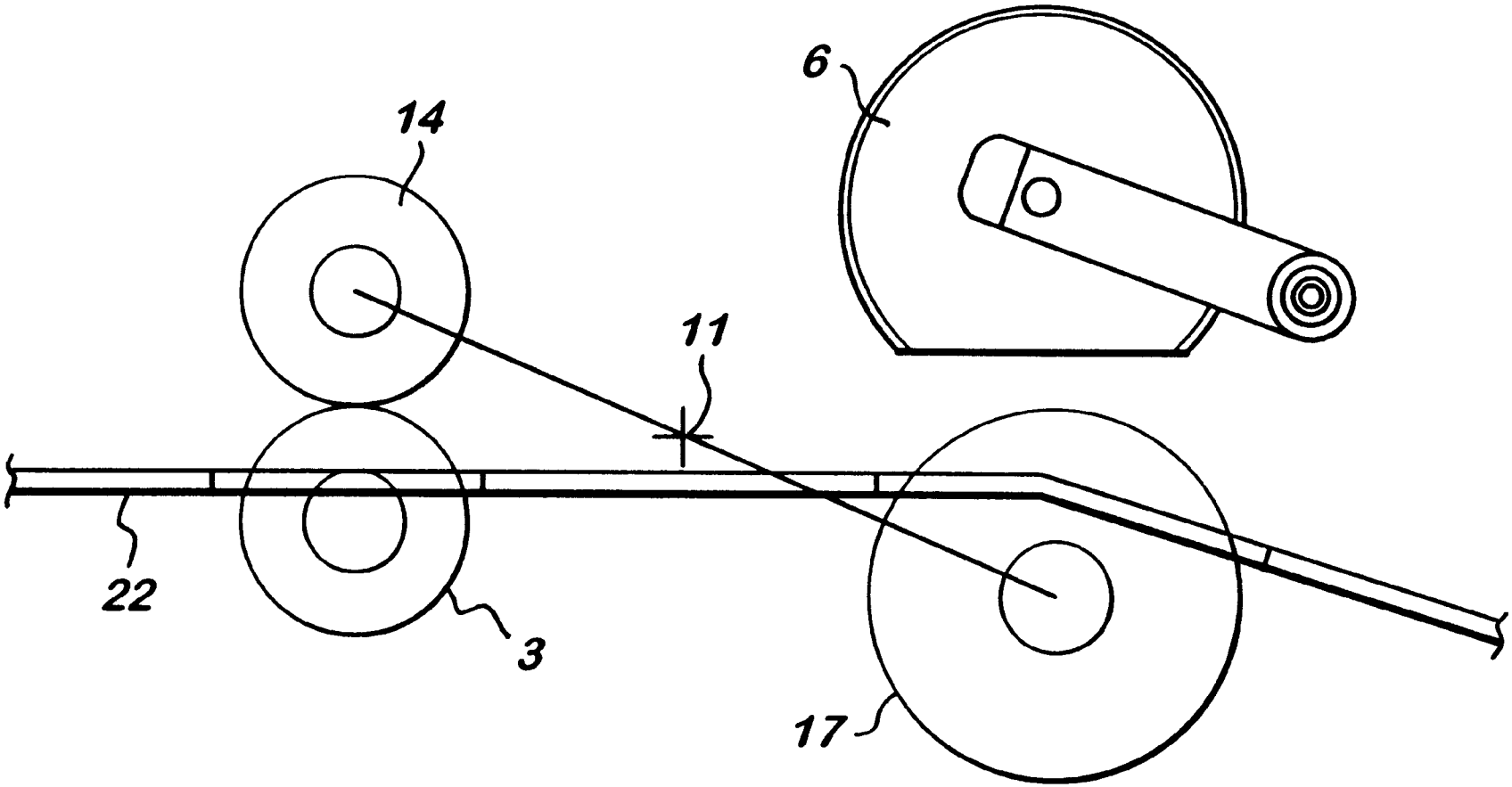
FIG. 2 is a front view of the machine of FIG. 1.
Figure 3:
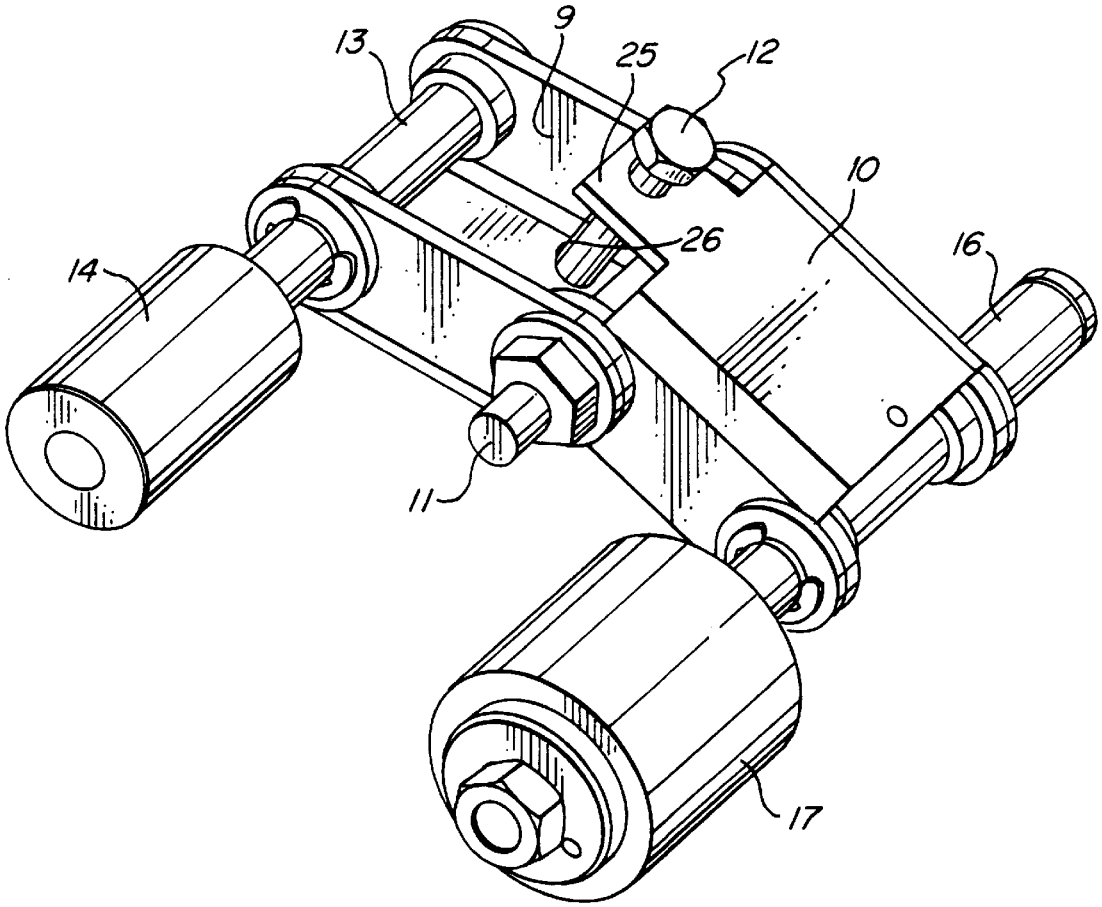
FIG. 3 is a perspective view of the compensating lever according to the invention.

FIG. 3 shows the embodiment of the pivoted lever comprising the compensation device of the invention. It is comprised of two covers 9,10, with cut corners, installed head-to-foot and both joined on Axis 11 screwed into Platen 1 (Cf. FIG. 1) and parallel to Arbors 4 and 7. On Extension 25 of its back, placed beside Pivot 11, Upper Cover 10 holds Screw 12 of which End 26 is in contact with the interior of the back of Lower Opposed Cover 9. Thus, Pivot 11 is a pivot with adjustable stop permitting the lever comprised of Covers 9 and 10 to function only in one direction of rotation.

At its end opposite Pivot 11, Cover 9 has Pivoting Axis 13 passing Platen 1 by suitable Light 27, at the end in front of which Roller 14 is installed. Roller 14 is free-moving and in contact pressure with Roller Motor 3 by operation of Draw Spring 15 holding Cover 9 to Dowel 28 installed in Platen 1 (cf. FIG. 1).

At its end opposite Pivot 11, at the same distance as Axis 13, Cover 10 has pivoting Axis 16, on which Counter-printing Roller 17 is installed. Counter-printing Roller 17 is in pressure contact with Printing Drum 6 by the operation of Draw Spring 18 holding Cover 10 to Dowel 20 installed in Platen 1 (cf. FIG. 1).

The simultaneous rotation of Counter-printing Roller 17 with that of Roller 3 is assured by Motor 5 by means of the set comprising Pulleys 19 and 21 installed on respective Arbors 4 and 16 and Belt 20 (FIG. 1).

Figure 4:
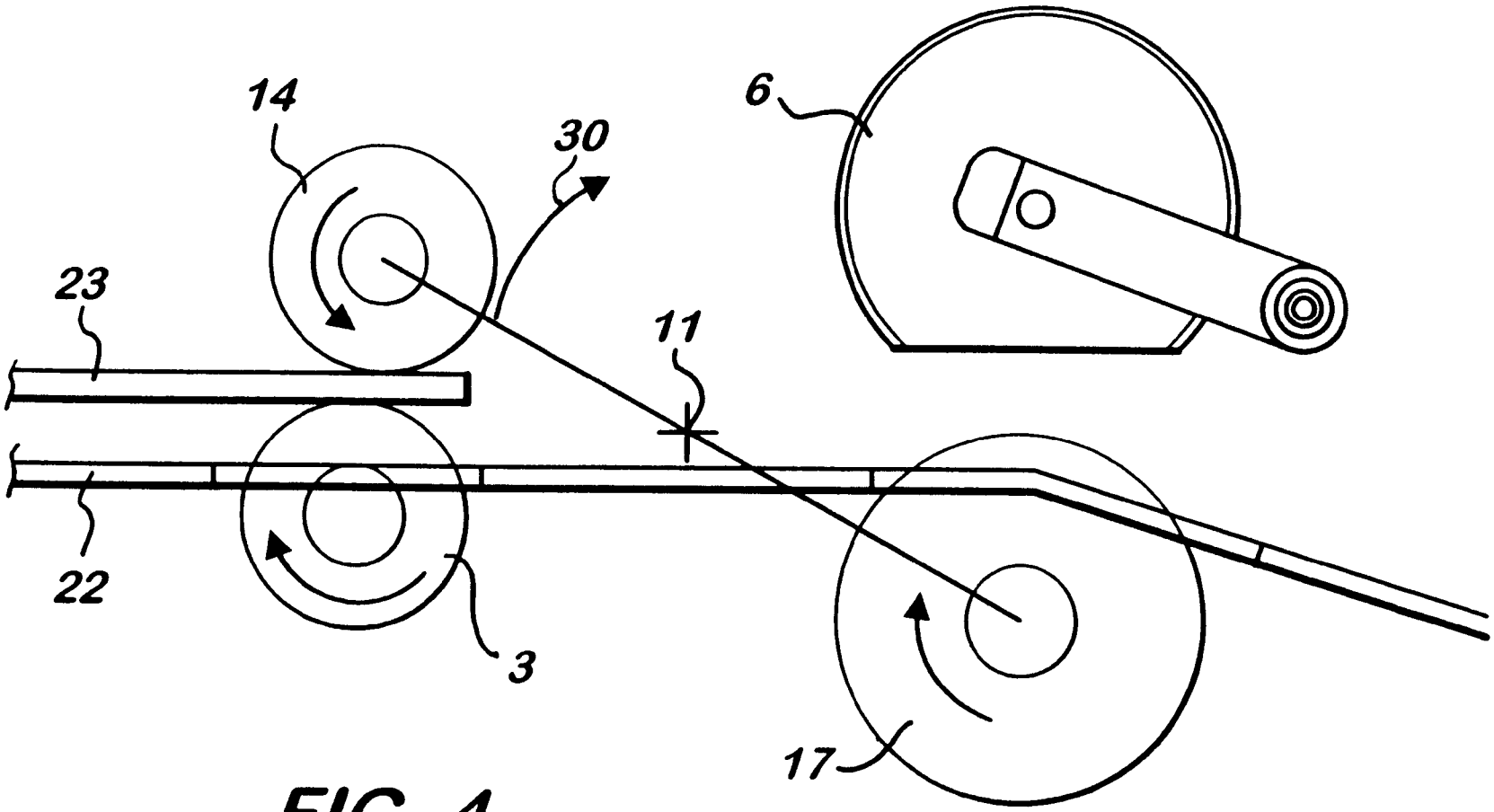
FIG. 4 is a schematic front view of the machine of FIG. 1, showing a first stage of the passage of an envelope, at its insertion.

FIG. 4 illustrates the first stage of insertion of an envelope. Envelope 23, coming from a conventional feed system not comprising part of the invention, is taken charge of by Feed Rollers 3 and 14. Putting Roller 3 in rotation is assured by Motor 5 by means of Arbor 4. The thickness of Envelope 23 constrains Roller 14 to shift in the direction of Arrow 30, that is, to be raised in relation to its resting position. Because of this, Cover 9 turns clockwise around Axis 11 and by the contact intermediation of Screw 12 with the interior face of Cover 9, Cover 10 likewise turns clockwise around Axis 11. Thus, Counter-printing Roller 17 moves away from Printing Drum 6, toward the bottom, by the magnitude of the thickness of Envelope 23, because the axes of rotation of Rollers 14 and 17 are placed at equal distances from Axis 11.

Figure 5:
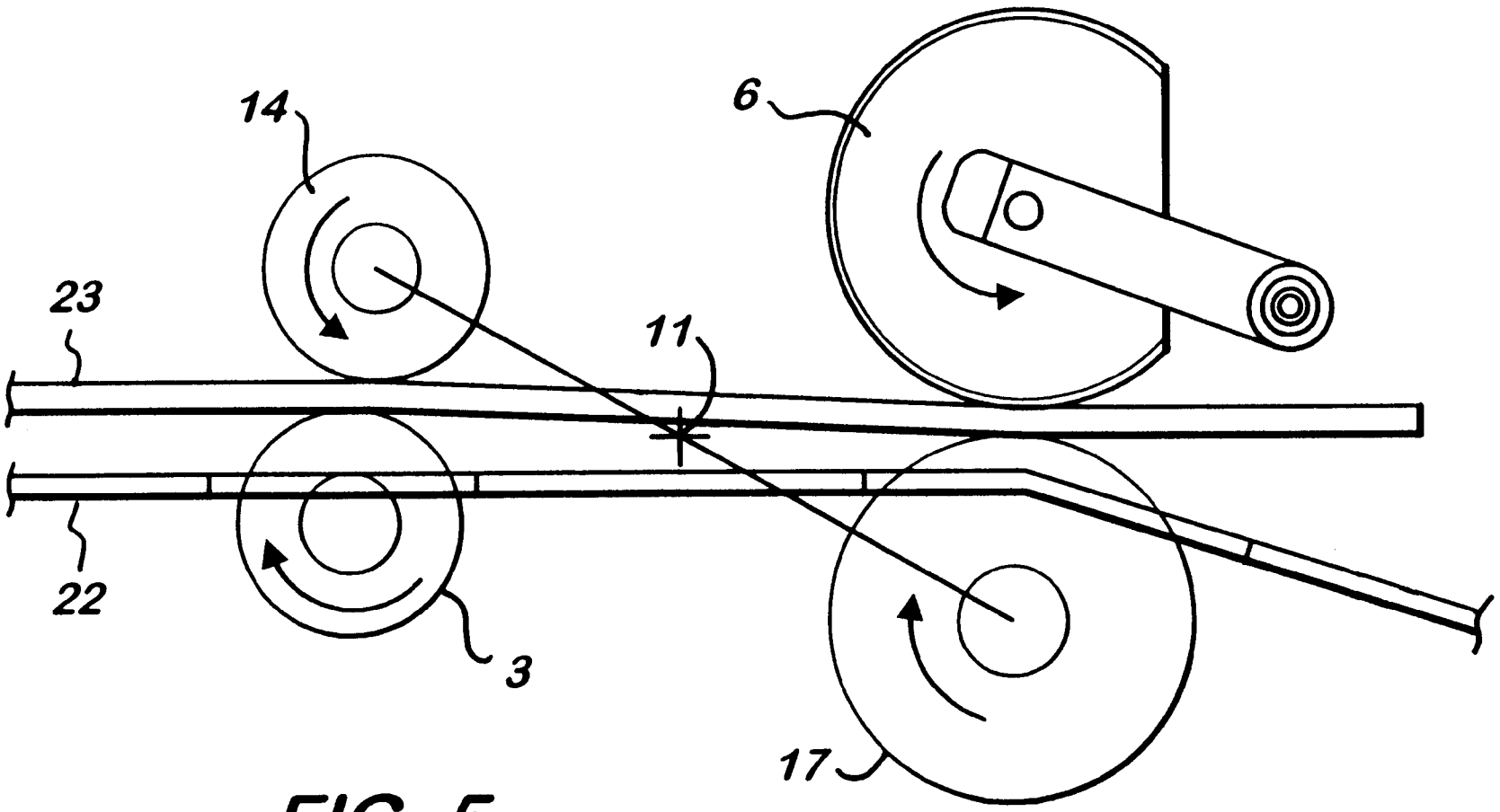
FIG. 5 is an analogous view of the machine of FIG. 1, showing a second stage of the passage of an envelope, during its printing.

FIG. 5 shows the following stage. Printing drum 6 is set into rotation by Motor 8 by intermediation of Arbor 7. Envelope 23 is now taken in by Feed Rollers 3 and 14 and at once between Printing Drum 6 and Counter-printing Roller 17, and Envelope 23 is imprinted by Drum 6.

Figure 6:
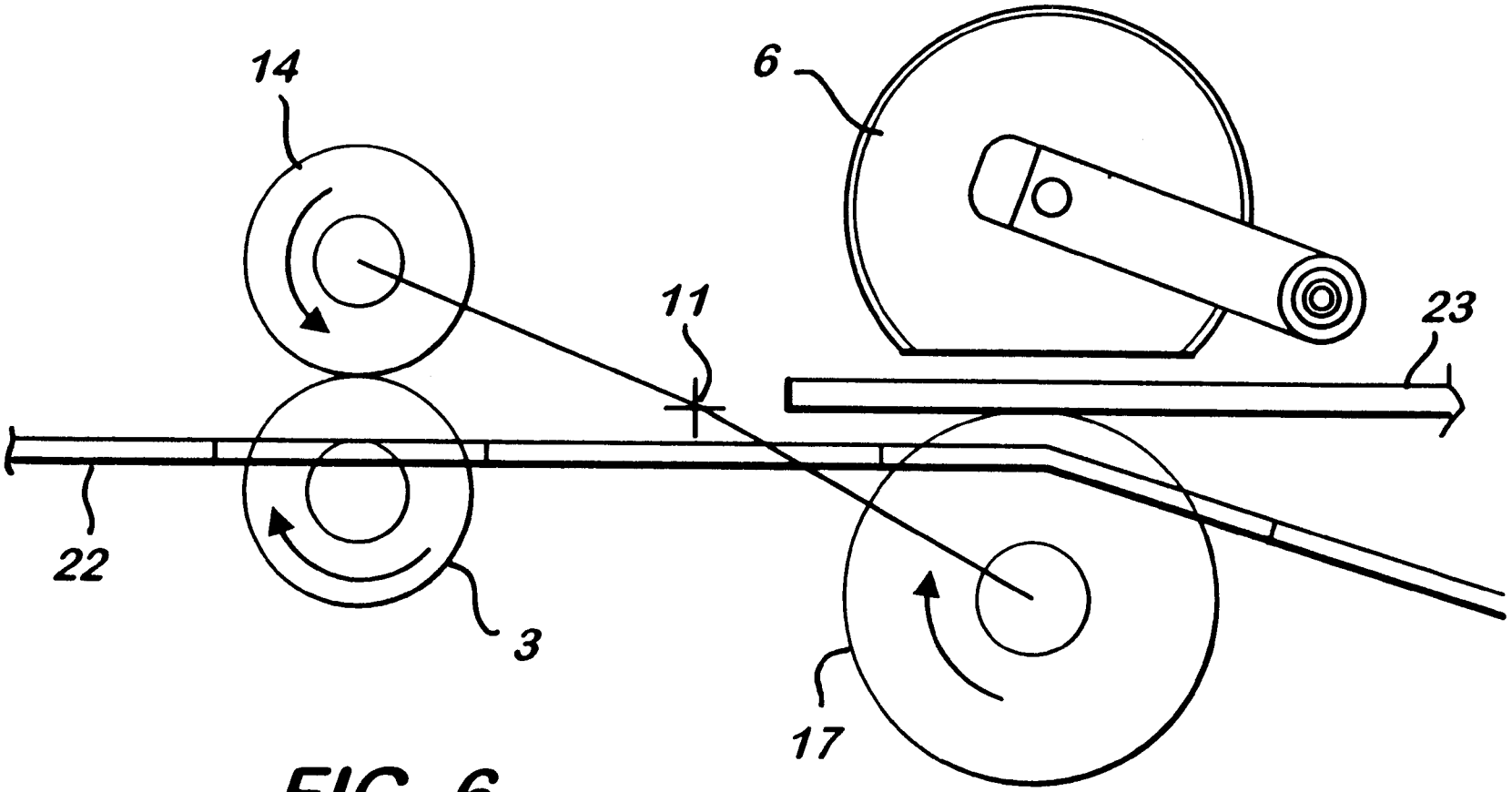
FIG. 6 is an analogous view of the machine of FIG. 1, showing a third stage of the passage of an envelope, after its printing.

Then, as FIG. 6 shows, Envelope 23 leaves Feed Rollers 3 and 14: the action of Return Spring 15 brings Roller 14 in contact with Roller 3, while Counter-printing Roller 17 is still in contact with the envelope, which is made possible by relative pivoting to stop of Covers 9 and 10. This being done, the mechanism is ready to accept a new envelope.

Figure 7:
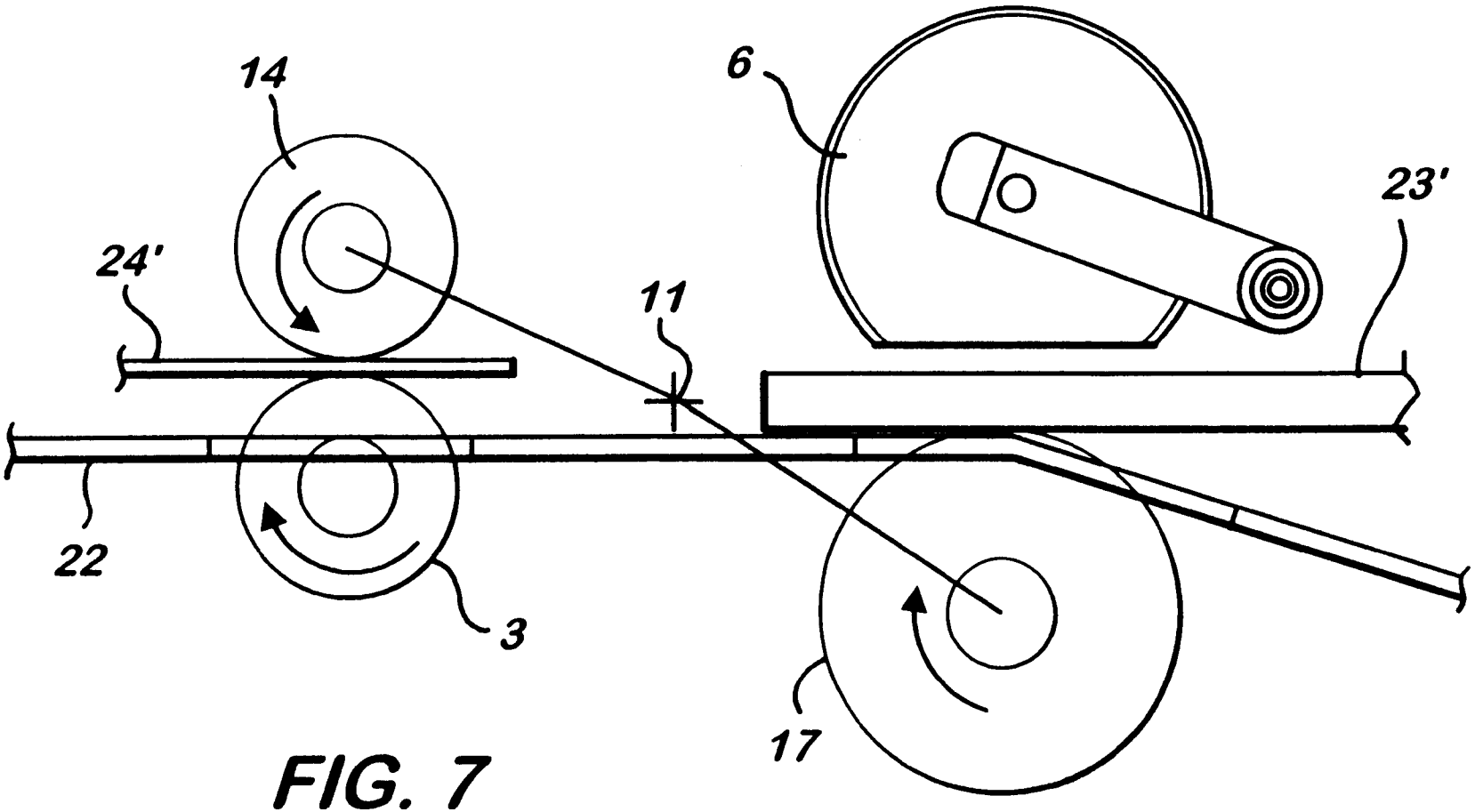
FIG. 7 is an analogous view of the machine of FIG. 1, showing the arrival of a new envelope, thinner than the one just printed.

FIG. 7 shows the arrival of Envelope 24', thinner than Envelope 23' which preceded it and is in the course of ejection. Naturally, Roller 14 is free to ride to the desired thickness, thanks to Pivot 11, which is not blocked, since Counter-drum 17 had already been shifted toward the bottom by a distance corresponding to the thickness of Envelope 23', above which Roller 14 must rise to allow Envelope 24' to pass.

Figure 8:
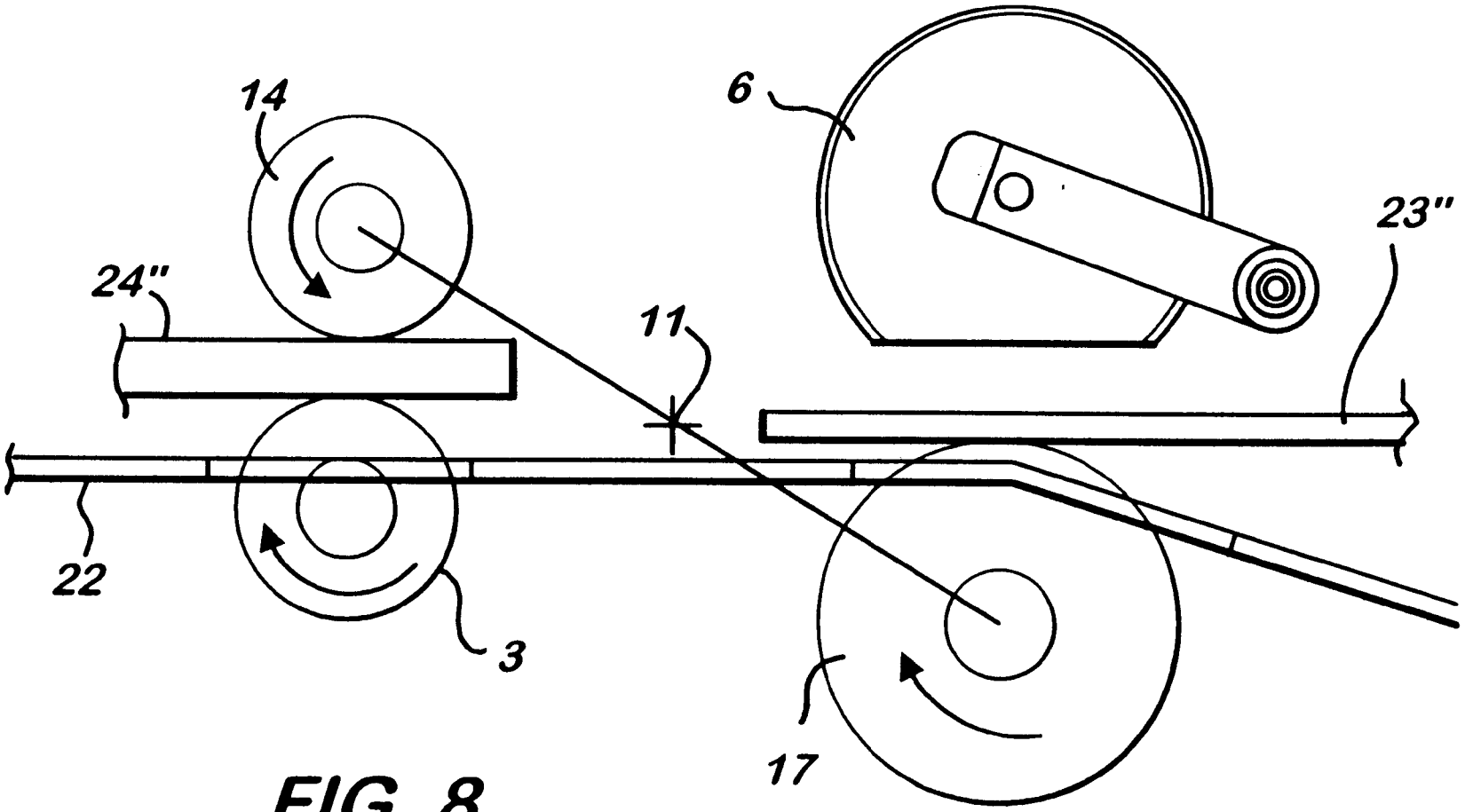
FIG. 8 is an analogous view of the machine of FIG. 1, showing the arrival of a new envelope, thicker than the one just printed.

FIG. 8 shows a contrary case of the arrival of Envelope 24", thicker than Envelope 23" which preceded it. The shift of Roller 14 upward, greater than the preceding case, is made and consequently spreads Roller 17 and Drum 6 still further from each other, without detrimental effect upon preceding Envelope 23", since printing this one is finished.

What is claimed is:

1. In a machine for printing flat objects of various thicknesses successively fed the length of a table by means of a feed mechanism and printed by means of a printing mechanism, the feed mechanism comprising at least two feed rollers between which the objects pass, each of the at least two feed rollers being rotatable about an axis of rotation and at least one of the at least two feed rollers comprising a motorized roller, and the printing mechanism comprising a revolving printing drum and a motorized counter-printing roller rotatable about an axis of rotation, the improvement comprising:

a lever having a first end, a second end, and a middle, the lever being pivotable at its middle and joined at its middle by a stop joint, the first end of the lever supporting the axis of rotation of the counter-printing roller, and the second end of the lever supporting the axis of rotation of one of the at least two feed rollers, such that shifting of the feed roller whose axis is supported by the lever, subsequent to the passage of an object between the at least two feed rollers, causes pivoting of the lever and thus a corresponding shifting of the counter-printing roller, if not already shifted by the passage of a preceding object.

2. The machine according to claim 1 further comprising a spring biasing the feed roller whose axis is supported by the lever toward contact with another of the at least two feed rollers, and a spring biasing the counter-printing roller toward contact with the print drum.

3. The machine according to claim 2 wherein the motorized feed roller and the motorized counter-printing roller are powered by a single motor and a belt-pulley assembly.

4. The machine according to claim 1, wherein the lever comprises two covers joined to one another by a joint.

5. The machine according to claim 4, further comprising an adjusting screw passing through a portion of one of the two covers and pressing against the other of the two covers, in order to comprise an adjustable stop of the joint.

6. The machine according to claim 5 further comprising a spring biasing the feed roller whose axis is supported by the lever toward contact with another of the at least two feed rollers, and a spring biasing the counter-printing roller toward contact with the print drum.

7. The machine according to claim 6 wherein the motorized feed roller and the motorized counter-printing roller are powered by a single motor and a belt-pulley assembly.

* * * * *